United States Patent [19]

Drath et al.

[11] 4,035,109

[45] July 12, 1977

[54] PUMP FOR FLUENT, AND ESPECIALLY HEAVY AND ABRASIVE MATERIALS

[76] Inventors: Edwin H. Drath, 1218 S. Patton, Arlington Heights, Ill. 60005; Paul Schlosser, 6820 W. Fuqua Drive, Missouri City, Tex. 77459

[21] Appl. No.: 607,284

[22] Filed: Aug. 25, 1975

[51] Int. Cl.[2] ..... F04B 7/04

[52] U.S. Cl. ..... 417/403; 417/489; 417/540

[58] Field of Search ..... 417/205, 244, 254, 258, 417/259, 260, 274, 540, 542, 489, 403; 92/60.5; 91/394

[56] References Cited

U.S. PATENT DOCUMENTS

| | | | |
|---|---|---|---|
| 2,670,877 | 3/1954 | Logue | 417/489 |
| 2,786,656 | 3/1957 | Corneil | 417/489 |
| 3,174,409 | 3/1965 | Hill | 417/403 |
| 3,730,398 | 5/1973 | Goda | 92/60.5 |
| 3,802,805 | 4/1974 | Roeser | 417/489 |
| 3,838,943 | 10/1974 | Ulbing | 417/494 |

*Primary Examiner*—Carlton R. Croyle
*Assistant Examiner*—G. L. LaPointe
*Attorney, Agent, or Firm*—Hill, Gross, Simpson, Van Santen, Steadman, Chiara & Simpson

[57] ABSTRACT

A pump for fluent materials, and especially suitable for heavy and abrasive materials, has a piston in substantial clearance relation within a cylinder and operable in a pumping stroke to drive into a combination valving, wiping and sealing elastomeric ring about the discharge portion from the cylinder, so that the pumped material has minimal drag and wearing contact with relatively moving parts in the pump. The pump is adaptable for double action and proportional pumping.

A self-reversing piston-driving fluid actuated motor is provided.

20 Claims, 4 Drawing Figures

PUMP FOR FLUENT, AND ESPECIALLY HEAVY AND ABRASIVE MATERIALS

This invention relates in general to pumps, and is more particularly concerned with a new and improved long lived versatile pump especially suitable for heavy and abrasive materials, and means for driving the pump.

Pumping of heavy and abrasive materials, such, for example, as encountered in some industrial processes and in the oil fields, and liquid-carried materials such as vermiculite, and the like, has been subject to severe problems and drawbacks, not the least of which has been the high incidence of wear of moving pump parts, and particularly piston and cylinder parts and associated valving heretofore considered necessary for pump operation.

Another problem with prior pumps has been the need for excessive and wasteful power consumption due to drag caused by generally close tolerance often involving metal-to-metal contact deemed necessary between relatively moving parts, and often heavy seal structures causing strong frictional resistances between the sealed parts.

An important object of the present invention is to overcome the disadvantages, deficiencies, inefficiencies, shortcomings and problems of prior pumps and to improve substantially the pumping of heavy fluent and abrasive materials.

Another object of the invention is to provide a new and improved pumping means.

A further object of the invention is to avoid and at least minimize power losses due to friction and drag in the pumping of heavy, e.g., high viscosity and/or solids-loaded, fluent materials.

Still another object of the invention is to provide new and improved pump means which will greatly reduce wear when pumping abrasive materials.

According to features of the present invention there is provided a pump for fluent materials and especially suitable for moving heavy fluent and abrasive materials, and comprising means defining a hollow cylinder chamber receptive of material to be pumped and having an axially extending chamber wall and opposite ends, a piston within and shorter than the cylinder chamber and having its perimeter in limited spaced gap relation to the chamber wall so that material can flow through the gap, means at one end of the cylinder chamber for guiding the piston in axial forward and return strokes relative to the opposite ends of the cylinder chamber, means defining a discharge port through the other end of the cylinder chamber, said port being of substantially smaller diameter than said chamber wall but of larger diameter than the cylinder perimeter, and a combination valving, sealing and wiping elastomeric ring concentric with and of smaller diameter than the piston perimeter and carried by said discharge port means, the piston being received in the ring during forward strokes of the piston and backing out of and away from the ring during return strokes of the piston.

Other objects, features and advantages of the invention will be readily apparent from the following description of a preferred embodiment thereof, taken in conjunction with the accompanying drawings although variations and modifications may be effected without departing from the spirit and scope of the novel concepts embodied in the disclosure, and in which.

Figures 1, 2, 3, 4:
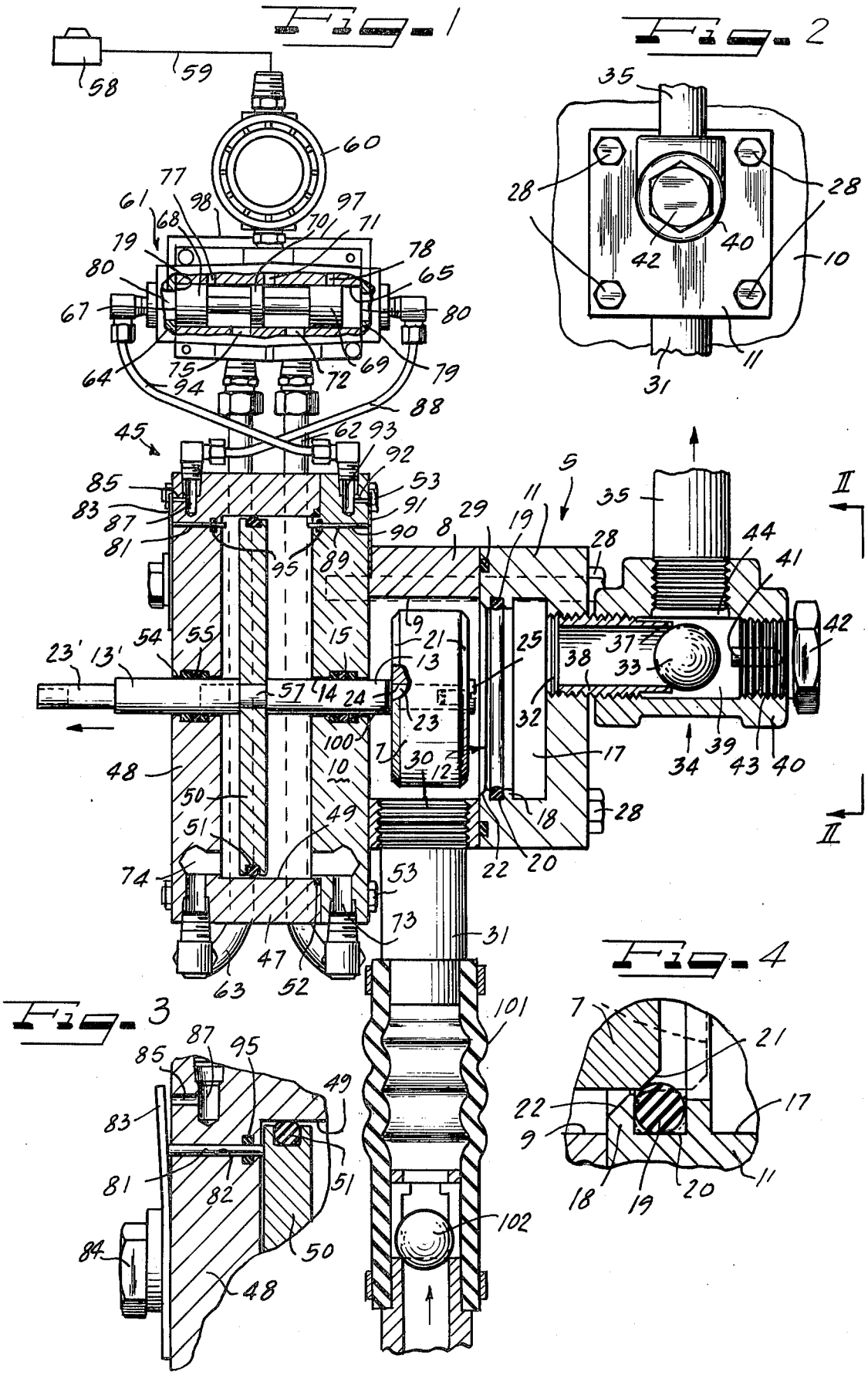
FIG. 1 is a longitudinal sectional elevational view through a representative pump embodying features of the invention, coupled with a fluid actuated driving motor.
FIG. 2 is an end elevational view taken substantially in the plane of line II—II of FIG. 1.
FIG. 3 is an enlarged fragmentary sectional detail view showing operation of one of the reversing bleed valves of the driving motor for the pump.
FIG. 4 is an enlarged fragmentary sectional detail view taken in substantially the same plane as FIG. 1 and showing the relationship of the piston and the elastomeric ring wiper seal.

According to the present invention pumping flow of material is effected in both forward and return strokes of a pumping piston. Combined volumetric and vacuum propulsion of material is effected in each forward and return stroke of the piston attaining excellent pumping efficiency. Frictional drag between relatively moving parts and wear by abrasion between relatively moving parts is reduced to a minimum.

By way of example, a pump 5 embodying features of the invention comprises a piston 7 of substantial diameter axially reciprocable within a hollow cylinder housing member 8 having an axially extending inner wall defining a cylinder chamber 9. One end of the chamber 9 is closed by an end plate 10 and the other end of the chamber 9 has means in the form of a generally cup-shaped end closure member 11 providing a discharge port 12. In the present instance, support of the piston 7 within the cylinder 9 is effected by means of an axial piston rod 13 which extends through an axial bore 14 in the closure plate 10 equipped with packing means preferably in the form of a plurality of O-rings 15. Thereby the bore 14 is adapted to be of differentially slightly larger diameter than the piston rod 13 while providing for effective support of the piston rod in reciprocably driving the piston 7 within the cylinder chamber 9.

For maximum pumping action yield, the piston 7 is of substantial diameter and operates in a short stroke. For example, the piston may be, as shown, of a diameter about three or more times the length of piston operating stroke. The length of the cylinder 9 is desirably about 1½ times the length of the piston 7 but may vary differentially in proportioning pump units as will appear more fully hereinafter. The diameter of the piston 7 is desirably sufficiently smaller than the diameter of the cylinder wall 9 so as to accommodate freely particles of the largest size that may be expected to be entrained in the material being pumped. In any event the piston perimeter will be differentially smaller diameter than and freely spaced from the cylinder wall 9 throughout the length of the cylinder. Thereby there is complete freedom from wear due to abrasive action of material between the relatively moving perimeter of the piston 7 and the cylinder wall 9. By constructing the piston 7 and the cylinder 8 from suitable material or at least surface treating or hardening the exposed surfaces of the piston 7 and the piston wall 9 protection against flowing material abrasion, chemicals, acids, alkalies and other potentially damaging factors can be guarded and protected against.

New and improved pumping action of the piston 7 in the cylinder 8 is attained by means cooperating with combination valving, sealing and wiping effect with the piston 7 at least during a terminal portion of the forward stroke of the piston. For this, the closure member 11 provides a blind end chamber 17 which, in effect, is a forward extension of the working chamber cylinder 9. Contiguous to the cylinder 9, and at the mouth of the chamber 17, means are provided on the member 11 defining the discharge port 12 and comprising an annular rib 18 (FIGS. 1 and 4) which is of substantially smaller diameter than the cylinder wall 9 but of larger diameter than the piston perimeter so that the piston 7 can move freely through the discharge port 12. To provide a combination valving, sealing and wiping effect, an elastomeric ring 19 of an inside diameter smaller than the diameter of the piston perimeter is mounted in a suitably dimensioned radially inwardly opening groove 20 in the rib 18. In one preferred form, the ring 19 is a O-ring of an outside diameter about the same as the diameter of the cylinder wall 9, thus providing a satisfactory cross sectional mass for the O-ring. As shown, a preferred arrangement comprises a depth of the groove 20 of about 75 to 80% of the cross sectional diameter of the O-ring body and with a substantial chordal portion of the inner diameter area of the O-ring projecting radially inwardly into the path of the margin of the piston 7. To facilitate safe engagement of the piston with the O-ring 19, the contacting edge portion of the piston is desirably provided with an annular chamfer 21 which may be on an angle of about 45° to the face of the piston and of a length about ⅓ the cross sectional diameter of the O-ring body. Thereby, when the piston 7 is driven in a forward stroke through the discharge port 12, the chamfer 21 contacts the O-ring 19 as a cam surface, progressively expanding the O-ring 19 into the preferably rectangular groove 20 and tensioning the O-ring to engage the piston perimeter with sealing, wiping effect both during forward advance and rearward backing off or retraction strokes of the piston while in engagement with the O-ring 19. In order to facilitate movement of material to be pumped from the cylinder chamber through the discharge port 12 and past the rib 18, the side edge of the rib 18 which is nearest the cylinder 9 is desirably provided with a lead-out chamfer cam surface 22.

As best seen in FIG. 4, the ring 19 provides the only surface in the pump with which the perimeter of the piston 7 engages at any time. All other surfaces within the pump remain at all times spaced from the perimeter of the piston 7, and in particular throughout the pumping stroke range of the piston.

Also as best seen in FIG. 4, the chamfered portion of the rib 18 which intervenes between the cylinder groove 20 and the working chamber 9 is of sufficiently smaller diameter (but larger diameter than the perimeter of the piston 7) than the portion of the rib which intervenes between the groove 20 and the chamber 17, so that freedom of movement of the piston through the port 12 is assured and the chamfered portion of the rib functions as a barrier against extrusion of the ring 19 past the barrier throughout the forward and return pumping range of the piston in engagement with the ring.

By preference, the piston 7 is constructed to be reversible, and for this purpose has both opposite ends of the same form, each provided with the chamfer 21. To this end, also, the piston rod 13 is provided with a reduced diameter axial stem extension 23 which projects axially through a complementary axial bore 24 in the piston 7, with means in the form of a retaining bolt 25 threaded into the end of the stem 23 and securing the piston against a shoulder 27 on the piston rod 13 about the base end of the stem.

Access to the piston 7 is facilitated by enabling easy separation of the closure member 11 from the cylinder member 8. For this purpose the members 8 and 11 may be of any desirable geometric outside configuration, with bolts 28 securing the members together and to the end plate 10 which is suitably tapped for this purpose. An annular seal 29 is provided at the interface joint between the members 8 and 11. Simply by removal of the bolts 28 and separation of the members 8 and 11, access is gained not only to the piston 7, but also to the O-ring 19, thereby facilitating reversal or replacement of the piston and when necessary replacement of the O-ring.

In a preferred system, both the forward and the return strokes of the piston 7 result in advancing material along the pump passage which includes the cylinder and the extension chamber 17. Accordingly, the cylinder 8 has a large flow area inlet port 30 providing a substantially unrestricted passage for material to be pumped, the material being supplied from a desired source through a conduit 31 such as a pipe or tube. No check valve is needed nor desired in the inlet 30 and need not be used in the conduit 31. While the supply of material to be pumped may reach the pump chamber 9 through the port 30 under some pressure, the pump is capable of producing sufficient suction to draw material through the port 30 so that the chamber is maintained filled with the material to be pumped during operation of the piston 7. During forward stroke of the piston 7, material is ejected through the discharge port 12 into the extension chamber 17 and thence through an outlet port 32 extending through the member 11 from the chamber 17 and controlled by means of a one-way check valve 33 in a fixture 34 from which a delivery duct 35 leads to a point of storage or utilization of the pumped material. In a desirable form, the check valve 33 comprises a ball member movable within a limited range from an annular valve seat 37 on the end of a coupling and valve seat tube 38 which is secured in the outlet port 32 and projects into a valve chamber 39 within a fixture housing 40 coupled to the member 11 by threaded engagement with the tube 38. A limit stop spring or pin 41 is carried by a threaded closure plug 42 secured in a port 43 aligned with the tube 38 and enabling axial adjustment of the stop 41 for optimum control of the valve 33. The delivery duct 35 is secured in a delivery port 44 in the wall of the fixture 40 communicating with the chamber 39. Through this arrangement, forward pumping strokes of the piston 7 cause material to be pumped through the outlet 32 past the check valve 33 and into the delivery duct 35. As the piston 7 advances toward the discharge port 12, volumetric displacement of material from the cylinder chamber is effected by a combination of pushing of the material through the discharge port 12 and displacement of the volume of the piston rod 13 advancing into the cylinder chamber. Upon engagement of the forward end of the piston 7 with the O-ring 19, a valving effect occurs wherein the cylinder chamber is closed from the extension chamber 17 and advance of the piston 17 through the sealing and wiping O-ring 19 results in a vacuum suction action back of the piston effective to draw material through the inlet port 30 into the cylinder chamber. Concurrently the piston 7 drives material on from the extension chamber 17 through the outlet port 32.

After the piston 7 has advanced through the O-ring 19 a limited distance, the piston is reversed. This produces a suction effect in the extension chamber 17 and the valve tube 38, closing the valve 33 and developing a negative pressure or vacuum in the chamber 17. As the piston 7 backs off in the return stroke, diminishing piston rod displacement substantially equals increasing piston displacement into the cylinder chamber until the discharge port 12 opens as the piston 7 backs out of and away from the O-ring 19 and the vacuum developed forwardly of the piston causes material to be drawn from the cylinder chamber into the extension chamber 17. This action together with continued reduction in piston rod displacement as the piston 7 moves in reverse in the cylinder chamber draws material from supply through the port 30 into the cylinder chamber and with the material displaced from in back of the returning piston 7 through the gap between the piston and the cylinder wall 9 to the front of the piston, continuing to the end of the return stroke of the piston whereupon the pump cycle may be repeated. It will thus be apparent that efficient pumping can be accomplished with advance of material through the pump in both forward and return strokes of the piston with only one check valve in the pumping system, namely the check valve 33 located downstream from the piston and without requiring a check valve in the piston or upstream from the piston since the piston itself acts as its own check valve. Desirably the inlet port 30 is at least as large in cross sectional flow area as the outlet ports 32 and 44, and preferably of larger cross sectional flow area so as to promote maximum pumping efficiency. Although the pump can be produced in small light weight unit size for pumping low viscosity fluids such as water, and particularly fluids that may contain solid contaminants, the pump is exceptionally capable in more rugged construction to move heavy, e.g. high viscosity fluent materials and abrasive materials, with very little wear factor.

Conveniently, a pump-actuating pressure fluid driven motor 45 may be constructed and arranged in compact unit assembly with the pump 5. To this end, the pump cylinder end closure plate 10 serves also as an end closure for one end of a motor cylinder 47 which may be constructed of generally cup shape provided with an integral opposite end closure 48. Within the cylinder 47 is a cylindrical chamber 49 of preferably substantially larger diameter than the pump cylinder chamber defined by the wall 9 and within which a driving piston 50 mounted on the piston rod 13 is reciprocably movable. For compactness, the piston 50 is as short as praticable having regard to pressures which it must withstand in use. By virtue of the large areas of the opposite faces of the piston 50 exposed for pressure application within the cylinder chamber 49, compared to substantially smaller face areas of the pump piston 7, substantial power to driving force ratio advantage is attained. About its perimeter, the driving piston 50 is of smaller diameter than the diameter of the wall defining the cylinder chamber 49 so that there is freedom from metal-to-metal contact, and an O-ring seal 51 seated in a complementary piston periphery groove 51a provides a dynamic seal between the piston and the cylinder. For example, in a typical example, the clearance between the perimeter of the piston 50 and the wall cylinder 49 may be on the order of 0.020 inch. Clearance of the same order is preferably maintained between the piston rod 13 and the bore 14. A static sealing ring 52 seals the joint between the closure plate 10 and the cylinder 47. Securing of the cylinder 47 to the plate 10 may be effected by means of bolts 53.

The disclosed arrangement lends itself to a dual pump drive wherein a duplicate of the pump 5 may be mounted on the motor closure 48, with an extension 13' of the piston rod provided with a reduced diameter distal terminal 23' for connection with the piston of the twin motor. For this purpose, the piston rod extension 13' extends through a clearance bore 54 in the closure 48 concentric with the bore 14 and with O-ring packing seal means 55 similar to the sealing packing 15 providing seal between the reciprocable piston rod extension 13' and the closure 48. In this arrangement, the piston 50 in the form of a disk is clamped between the adjacent ends of the piston rod 13 and the piston rod extension 13', one of the piston rod members being provided with a reduced diameter coupling extension 57 which may be threadedly engaged within the adjacent end of the other of the piston rod members, and with the piston 50 engaged between the shoulders provided by the adjacent ends of the piston rod members.

Actuation of the driving piston 50 is effected by fluid power, pneumatic or hydraulic, derived from a suitable source 58 (FIG. 1) such as a pump or compressor. A duct 59 conveys the pressurized motivating fluid to the motor 45 through a regulator 60 to a control valve 61 which selectively directs the pressure fluid to one side or the other side of the motor piston 50 by way of respective delivery ducts 62 and 63. The control valve 61 comprises a housing 64 provided with a longitudinal bore 65 within which is reciprocably mounted a valve spool 67 having a head 68 at its left hand end as viewed in FIG. 1 and a similar head 69 at the opposite end. These heads 68 and 69 are spaced from a central narrow control land 70 which controls flow of motivating pressure fluid from the regulator 60 through a supply port 71 opening into the bore 65 centrally along the length of the bore. Thereby, when the land 70 is located at the left of the port 71 as viewed in FIG. 1, the pressure fluid is directed to flow through the valve into a supply port 72 opening from the casing 64 offset to the right relative to the supply port 71 and communicating with the duct 62 which delivers to the front end of the piston 50 which is thus actuated toward the left, that is to drive the piston 7 in reverse stroke. For this purpose, the delivery end of the duct 62 is suitably coupled to an angular passage 73 in the closure 10 delivering through the inner face of the closure into the cylinder chamber 49. During such movement of the piston 50, pressure fluid is exhausted from the cylinder chamber 49 at the opposite side of the piston by means of an angular connecting passage 74 in the end closure 48 and which is coupled with the end of the duct 63 remote from the valve 61. Thereby the exhausting fluid travels by way of the duct 63 into the bore 65 by way of a port 75 in the casing 64 offset to the left of the supply port 71 and communicating through the groove in the valve spool 67 between the head 68 and the divider 70 with an exhaust port 77 sufficiently spaced from the supply port 71 to be closed off by the head 68 when the valve spool 67 is shifted to the right to effect communication between the supply port 71 and the duct 63 by way of the port 75 and the passage 74 to reverse the piston 50 to move toward the right and drive the piston 7 in a forward stroke. When the valve spool 67 is thus shifted, the divider land 70 shuts the port 72 from the port 71, and the spool head 69 uncovers an exhaust port 78 counterpart to the port 77 and at the opposite side of the port 71 for exhaust communication with the port 72 and thereby through the duct 62 and the angular passage 73 with the piston chamber 49 at the forward face of the piston 50.

Means are provided for automatically reversing the driving piston 50 when it reaches the respective opposite ends of the strokes in its cycle of operation. To this end, the bore 65 is of a length just sufficient to permit a limited range of reciprocal movements of the valve spool 67, stopping the spool by engagement of its ends with respective stop shoulders 79 at the ends of the bore. In communication with the respective opposite ends of the valve spool through the shoulders 79 are respective spool controlling chambers 80 which are adapted to be selectively opened and closed to atmosphere whereby to unbalance pressure fluid thrusts on the valve spool surfaces to effect shifting of the valve spool alternately from one end to the other end of the valve bore 65. Thus, by opening the chamber 80 at the left end of the valve spool will cause unbalance to shift the valve spool to the left, and similarly opening the chamber 80 at the right end of the spool 67 to atmosphere will cause shifting of the spool to the right.

Opening of the valve spool shifting chambers 80 alternately to atmosphere is effected automatically by the driving piston 50 reaching respective opposite ends of its cyclical strokes. For this purpose, a trip plunger 81 is mounted reciprocably in a complementary bore 82 in the closure 48 and is of sufficiently greater length than the width or thickness of the closure 48 so that the plunger can be shifted from a position wherein its inner end extends inwardly into intercepting relation to the piston 50, as best seen in FIG. 1 to be engaged by the piston and shifted in outward direction so that the outer end of the plunger projects beyond the surface at the outer end of the bore 82, as shown in FIG. 3. When the plunger 81 is thus shifted by the piston 50, the outer end of the plunger opens a control valve desirably in the form of a leaf or reed spring 83 which is anchored as by means of a bolt 84 to assume a position normally in closing relation to an atmosphere port 85 in the end member 48 communicating with a passage 87 to which is coupled in communication a duct 88 coupled at its opposite end to the control chamber 80 at the right end of the valve spool 67. Only a short travel distance of the plunger 81 effects a substantial opening movement of the spring valve 83 relative to the port 85 adjacent to the free end of the spring valve by having a plunger engage the spring valve as close as practical to the point of anchorage of the spring valve.

For the same purpose, a control plunger 89 mounted reciprocably in a complementary bore 90 in the closure 10 is of a length to be displaced longitudinally by the piston 50 to cause the outer end of the plunger 89 to flex a valve spring 91 into opening relation to a bleed port 92 communicating with a bleed passage 93 in the closure member 10 through a suitable coupling with a bleed duct 94 coupled at its opposite end in communication with the control chamber 80 at the left end of the valve spool 67. The valve spring 91 may be conveniently anchored by engagement at its proximal end portion between the end closure 10 and the adjacent end of the pump cylinder member 8, as shown. Leakage past the plungers 81 and 89 is prevented by suitable packing 95.

In order to stabilize positioning of the valve spool 67 and to assure unbalanced axial fluid pressure to shift the plunger when either of the bleed passages from the control chambers 80 is opened, a constant limited pressure fluid bleed input into each of the chambers 80 is provided for. Thus, a pressure bleed line 97 effects communication between the pressure fluid supply and the chamber 80 at right end of the valve spool 67 and a similar pressure bleed line 98 communicates between the pressure fluid supply and the chamber 80 at the left end of the valve spool. As a result, when the atmospheric bleed valves 83 and 91 are both closed, the pressure bleed through the lines 97 and 98 maintains valve spool stabilizing, that is position retaining, static pressure in the chambers 80 and on the adjacent ends of the valve spool heads 68 and 69. Whenever the valves 83 and 91 are opened alternatively by action of the piston 50, as described, not only does the pressure at the end of the valve spool that is opened to atmosphere bleed off, but pressure entering the opposite chamber 80 acts with pressure from the supply port 71 to effect a substantially snap reversal of the valve spool position, thereby causing reversal of the motor piston stroke. This causes snap closing of the open spring valve 83 or 91, as the case may be, the spring valve in each instance moving its associated trip plunger 81 or 89 to the ready position projecting inwardly toward the motor piston 50.

In addition to provision for dual pump operation, wherein each end of the piston rod 13, 13' may carry a piston and each side of the motor 45 coupled to one of the pump units 5, so that in the stroking of the motor pumping is effected by each of the pumps 5 alternately, so that different fluent materials can be pumped by operation of the same motor, or the same material may be pumped to a common point of use such as a spraying of coating applicator device for increased volume or reduction in pressure fluctuations, or the like, the arrangement also lends itself efficiently to proportional volume pumping. For example, in the application of urethane coatings such as to ship hulls, and wherein reacting materials are brought together to cure into the end product and must be properly proportioned, one of the dual pumps will move one of the materials to the applicator and the other of the pumps will move the other material to the applicator in properly proportioned supply. One way of accomplishing the proportional pumping relationship is to have the respective pump pistons 7 off suitable differential length so as to have the strokes properly relatively proportioned for proportioned volume displacement. In another arrangement the lengths of the cylinder chambers 9 may be properly proportioned, or the location of the sealing and wiping ring 19 properly differentially located with respect to the piston stroke. This may be varied, for example, by inserting suitable thickness gasket shim in the joint between the members 8 and 11. On the other hand, one or more spacer washers 100 may be located between the back of one of the pistons 7 and the shoulder of the enlarged portion of the piston rod 13, 13' to lengthen the stroke of one of the pistons relative to the length or stroke of the other of the pistons in the dual pump arrangement, alternatively to shorten the stroke by removal of one or more of the washers. In any event, the differential stroke length of the pistons relative to the associated valving, wiping, sealing ring 19 will effect the proportional pumping.

Although vacuum suction effected in stroking of the pistons 7 generally suffices to fill the cylinder chamber 9 and the extension pump chamber 17 with substantial freedom from cavitation, it may sometimes be desirable to provide pressure booster means for the material supplied through the supply duct 31. Such means may comprise a resiliently flexible storage section 101 in the supply line with a check valve 102 at its upstream end. Through this arrangement, in each pumping stroke of the pistons 7 as material is driven from the pump chamber and drawn from the supply duct 31, replenishing supply of material can readily pass the check valve 102. During any short interval in which there is any tendency for back pressure in operation of the piston 7, the check valve 102 closes and the resiliently flexible storage chamber is adapted to expand to accommodate and store the material that may tend to back off or return through the supply duct, developing a booster pressure which on opening of the pump flow path past the piston 7 boosts material supply into the pump chamber.

From the foregoing, it will be apparent that the present invention provides a new and improved reciprocating piston pump, as well as a pump and motor combination, and wherein all piston and piston rod surfaces are free from metal-to-metal contact with respect to housing or cylinder surfaces. Not only is this advantageous because of greatly reduced liability to wear as compared with arrangements where there is metal-to-metal contact of relatively moving parts, but greatly improved tolerances are permitted, reducing costs, while at the same time efficiency is substantially improved. A wide range of utility is afforded since the principles of the invention are adapted for pumps capable of efficiently handling relatively low viscosity materials when suitably arranged with small tolerances between piston and cylinder up to extremely stiff materials with wide tolerances. For example, materials can be handled of such inherent stiffness or viscosity that a one inch stream or column of the material can stand several inches high without sagging. Prior pumps for such material have worn out very rapidly. In the pump of the present invention the pumping piston is wiped clean by the only part that is contacts, namely, the combination valving, sealing and wiping ring. The pump is tolerant of particulate matter of substantial size in the material stream. Such particulate material may or may not be abrasive. Abrasive materials are easily and efficiently handled and do not present problems insofar as the pumping piston or cylinder are concerned as compared to prior pumps. Maximum pumping yield from power input is attained. Because of the unique construction of the pump, it can even run dry indefinitely without overheating or other deterioration. Dual pump efficiency is provided for, and this may comprise proportional volume pumping by differential length of pumping strokes of dual pistons.

It will be understood that variations and modifications may be effected without departing from the spirit and scope of the novel concepts of this invention.

We claim as our invention:

1. A pump for fluent materials and especially suitable for moving heavy fluent and abrasive materials, comprising:

a housing member providing a hollow cylinder chamber receptive of material to be pumped and having an axially extending chamber wall and opposite ends;

a piston within and shorter than the cylinder chamber and having its perimeter of smaller diameter than and in limited spaced gap relation to said wall so that material can flow through the gap;

a closure at one end of the cylinder chamber having means for guiding a piston rod of the piston for axial forward and return strokes of the piston relative to the opposite end of the cylinder chamber;

means for driving the piston rod and thereby the piston in said forward and return strokes;

a generally cup-shaped end closure rigid with said opposite end of the cylinder chamber, and said cup-shaped closure having a blind end chamber which forms a forward extension from the cylinder chamber and into which the piston extends a limited distance in the forward stroke of the piston, said blind end extension chamber having a wall diameter which is larger than the diameter of the piston perimeter so that there is a spaced gap relation between the piston perimeter and said extension chamber when the piston extends into said extension chamber;

means for introducing into said cylinder chamber material to be pumped;

check valved means for receiving pumped material from said extension chamber;

a rigid annular rib between said cylinder chamber and said extension chamber and having a radially inner annular rib surface which extends to a smaller diameter than the diameters of the cylinder chamber wall and the extension chamber wall but is of a substantially larger diameter than the piston perimeter diameter, said rib defining a port through which the piston moves freely and in substantial annularly spaced gap relation in a forward stroke from a position wherein the forward end of the piston is entirely within the cylinder chamber and clear of said rib to a position wherein the piston projects partially through said rib; and a combination valving, sealing and wiping elastic ring engaged with said rib and having an annular portion projecting radially inwardly beyond said inner annular surface of the rib to a substantially smaller diameter than the diameter of the piston perimeter;

said projecting annular portion of the elastic ring extending across said gap and being engaged by the piston during the forward stroke through said rib into said extension chamber, and the piston perimeter elastically expanding the radially inwardly projecting portion of the elastic ring into a tensioned sealing and wiping annular gripping engagement with the piston perimeter and maintaining pumping pressure in said extension chamber against leakage past said rib and the piston during said forward stroke of the piston and the extension chamber;

said rib providing a rigid annular portion between said cylinder chamber and the elastic ring serving as a backup barrier for the elastic ring to prevent backward extrusion of the ring into the cylinder chamber due to pumping pressure in said extension chamber;

said piston producing a suction effect and developing a negative pressure in said extension chamber during the return stroke of the piston;

said piston completely withdrawing from the elastic ring at the end of said return stroke so that material can flow from said cylinder chamber past said piston and through said rib and said elastic ring into said extension chamber in response to said negative pressure;

said projecting annular portion of the elastic ring providing the only surface in the pump with which the perimeter of the piston engages at any time and all other surfaces within the pump including said rib remaining at all times substantially spaced from the piston perimeter.

2. A pump according to claim 1, wherein said rib portion has an oblique annular lead-out surface on its cylinder chamber side to facilitate movement of material from the cylinder chamber past said rib portion into said extension chamber.

3. A pump according to claim 1, wherein said discharge port defining means comprise an annular rib having an annular groove within which the elastomer ring is seated, said groove having an oblique annular lead-in surface slanting generally from said cylinder wall toward said discharge port.

4. A pump according to claim 1, wherein said housing member said end closure comprise separable members, and means for securing said members together permitting separation of the members for quick access to said piston and said elastic ring.

5. A pump according to claim 4, said closure at said one end of the cylinder being a plate, and said securing means securing said members in assembly with said closure plate.

6. A pump according to claim 1, said closure across said one end of the cylinder, being a plate said closure plate having a piston rod bore therethrough and through which the piston rod extends, said bore being differentially larger diameter than said piston rod, and sealing ring packing carried by said closure plate within said bore and maintaining a spaced relation of the piston rod relative to the bore.

7. A pump according to claim 6, including a fluid motor cylinder mounted on the opposite side of said closure plate from said pump cylinder, a motor piston carried by said piston rod within said motor cylinder, and means providing motivating fluid for actuating said motor piston reciprocably in the motor cylinder and thereby driving said pump piston in said forward and return strokes.

8. A pump and motor according to claim 7, including means operable by said motor piston for automatically reversing action of the motivating fluid on said motor piston.

9. A pump according to claim 8, wherein said means for reversing the action of the motivating fluid include a reciprocable spool valve, means for stabilizing position of the spool valve in opposite reciprocable positions, and means for effecting shifting of the spool valve responsive to the motor piston.

10. A pump according to claim 7, wherein said motor cylinder has a closure at its end opposite to said closure plate, a piston rod extension coaxial with said piston rod and projecting from said motor piston through a bore in said motor cylinder closure, said piston rod extension being adapted to be coupled for driving of a second motor piston.

11. A pump according to claim 7, wherein said motor cylinder and piston are of substantially larger diameter than said pump cylinder and piston.

12. A pump according to claim 1, including means for adjusting the length of the pumping stroke of said piston.

13. A pump according to claim 12, wherein said piston rod has an extension adapted to mount a piston for a similar companion pump for concurrent stroking with said first mentioned piston.

14. A pump according to claim 1, including a valveless material inlet of substantial cross sectional flow area into said cylinder chamber, means for supplying material to the cylinder chamber through said inlet including a pressure booster comprising a resiliently flexible expansile tubular section in a duct leading to said inlet, and a check valve upstream of said pressure booster preventing return flow from the booster.

15. A pump for fluent materials and especially suitable for moving heavy fluent and abrasive materials, comprising:

means defining a hollow cylinder chamber receptive of material to be pumped and having an axially extending chamber wall and opposite ends;

a piston within and shorter than the cylinder chamber and having its perimeter in limited spaced gap relation to said wall so that the material can flow through the gap;

means at one end of the cylinder chamber for guiding the piston in axial forward and return strokes relative to the opposite end of the cylinder chamber;

means defining a discharge port from said opposite end of the cylinder chamber, said port being of substantially smaller diameter than said chamber wall but of larger diameter than the piston perimeter; and a combination valving, sealing and wiping elastomeric ring concentric with and of smaller inside diameter than said piston perimeter and carried by said discharge port means, the piston being received in said ring during forward strokes of the piston and backing out of and away from the ring during return strokes of the piston;

said discharge port defining means comprising an annular rib having an annular groove within which the elastomeric ring is seated;

said rib having an oblique annular lead-in surface slanting generally from said cylinder wall toward said discharge port.

16. A pump for fluent materials and especially suitable for moving heavy fluent and abrasive materials, comprising:

means defining a hollow cylinder chamber receptive of material to be pumped and having an axially extending chamber wall and opposite ends;

a piston within and shorter than the cylinder chamber and having its perimeter in limited spaced gap relation to said wall so that material can flow through the gap;

means at one end of the cylinder chamber for guiding the piston in axial forward and return strokes relative to the opposite end of the cylinder chamber;

means defining a discharge port from said opposite end of the cylinder chamber, said port being of substantially smaller diameter than said chamber wall but of larger diameter than the piston perimeter for substantial gap relationship therewith;

a combination valving, sealing and wiping elastomeric ring concentric with and of smaller inside diameter than said piston perimeter and carried by said discharge port means, the piston being received in said ring during forward strokes of the piston and backing out of and away from the ring during return strokes of the piston;

a valveless material inlet of substantial cross sectional flow area into said cylinder chamber;

means for supplying material to the cylinder chamber through said inlet including a pressure booster comprising a resiliently flexible expansile tubular section in a duct leading to said inlet;

and a check valve upstream of said pressure booster preventing return flow from the booster.

17. A pump according to claim 16, wherein said port defining means comprise an annular barrier against extrusion of the ring toward said cylinder chamber throughout the forward strokes and return strokes of the piston.

18. A pump according to claim 17, wherein said means defining a discharge port comprises a rib having a groove therein within which said ring is seated, and said barrier comprises a portion of the rib intervening between said groove and said cylinder chamber.

19. A pump according to claim 17, wherein said barrier has an oblique annular lead-in surface slanting generally from said cylinder wall toward said discharge port.

20. A pump according to claim 15, including a valveless material inlet of substantial cross sectional flow area into said cylinder chamber, means for supplying material to the cylinder chamber through said inlet including a pressure booster comprising a resiliently flexible expansile tubular section in a duct leading to said inlet, and a check valve upstream of said pressure booster preventing return flow from the booster.

* * * * *